US005362048A

United States Patent [19]

Haste

[11] Patent Number: 5,362,048

[45] Date of Patent: Nov. 8, 1994

[54] GOLF CLUB

[76] Inventor: J. William Haste, 2529 W. Sherman, Peoria, Ill. 61604

[21] Appl. No.: 162,594

[22] Filed: Dec. 6, 1993

[51] Int. Cl.[5] ..... A63B 53/10

[52] U.S. Cl. ..... 273/80.2; 273/80.4; 273/80.6; 273/80 B; 273/80 C

[58] Field of Search ..... 273/80 R, 80 B, 80 C, 273/80.2, 80.4, 80.6

[56] References Cited

U.S. PATENT DOCUMENTS

| | | | |
|---|---|---|---|
| 1,892,482 | 12/1932 | Cash, Jr. | 273/80.4 |
| 2,153,550 | 4/1939 | Cowdery | 273/80 B |
| 4,809,983 | 3/1989 | Langert | 273/80.2 X |

FOREIGN PATENT DOCUMENTS

| | | | |
|---|---|---|---|
| 854911 | 11/1952 | Germany | 273/80.2 |

*Primary Examiner*—Vincent Millin
*Assistant Examiner*—Raleigh W. Chiu
*Attorney, Agent, or Firm*—Senniger, Powers, Leavitt & Roedel

[57] ABSTRACT

A golf club has a head having a generally forwardly directed face constructed for striking a golf ball, a shaft extending outwardly from the head and having a grip portion thereon for gripping the shaft to swing the club, and a connector located between and interconnecting the head and the shaft. The connector is relatively more resiliently yieldable than the shaft and the head. The connector is also constructed for deflecting the path of air generally downwardly as the club is swung.

14 Claims, 2 Drawing Sheets

GOLF CLUB

BACKGROUND OF THE INVENTION

This invention relates generally to golf clubs, and more particularly to a golf club having a unique connector between the head and shaft of the golf club.

In the game of golf, putting is widely regarding as being perhaps the most important skill required to score well. For most golfers, it is physically impossible to reach the vast majority of greens in less than a regulation number of strokes. Thus, if the otherwise skilled golfer is to break or save par it will frequently be necessary to hole out with only a single putt. In my experience, poor putting may occur when the golfer grips the shaft too tightly, such as frequently occurs when the golfer is attempting to make a short putt. The golfers grip is believed to affect the force applied to the ball when putting. Presently, the rigid connection between the shaft and head of a putter is believed to transmit substantially all of the tension in the golfer's grip to the club head. Thus, the feel of the shot and the impact applied to the ball undesirably vary with the tightness of the grip, rather than varying solely with the speed of the stroke.

Another important aspect of putting is the desire to obtain the maximum roll of the ball with the minimum of effort by the golfer. The golfer can generally putt more proficiently if his swing is smooth and easy, even on long putts. In that regard, it is helpful to strike the ball when the putter is actually on the upstroke so as to impart a greater topspin motion to the ball. The golfer is thus able to putt the ball greater distances with a more controlled swing. There is presently a need for a putter which facilitates the application of topspin to the golf ball.

SUMMARY OF THE INVENTION

Among the several objects and features of the present invention may be noted the provision of a golf club in which the effect of the golfer's grip of the club on the impact applied to the ball is diminished; the provision of such a golf club which facilitates striking the ball with a slightly upward component for imparting topspin to the ball; and the provision of a golf club which is of sturdy construction, and which is easy to manufacture and use.

Generally, a golf club comprising a head having a generally forwardly directed face constructed for striking a golf ball. A shaft extends outwardly from the head and has a grip portion thereon for gripping the shaft to swing the club. A connector located between and interconnecting the head and the shaft is relatively more resiliently yieldable than the shaft and the head.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
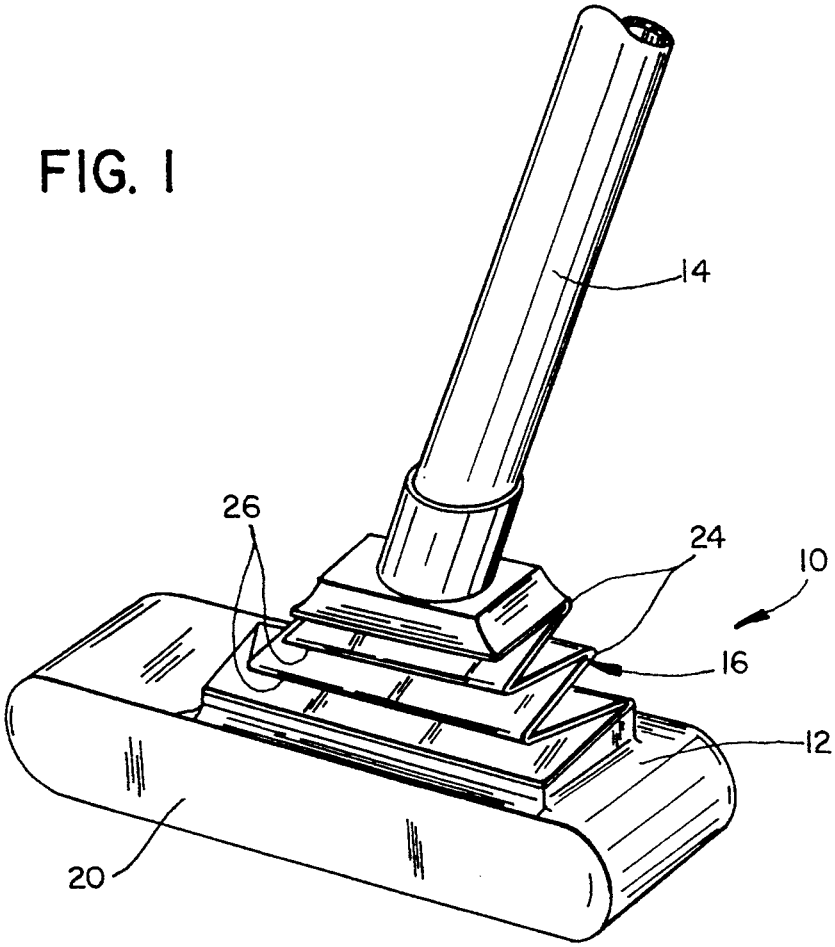
FIG. 1 is a fragmentary perspective view of a golf club of the present invention.
Figure 3:
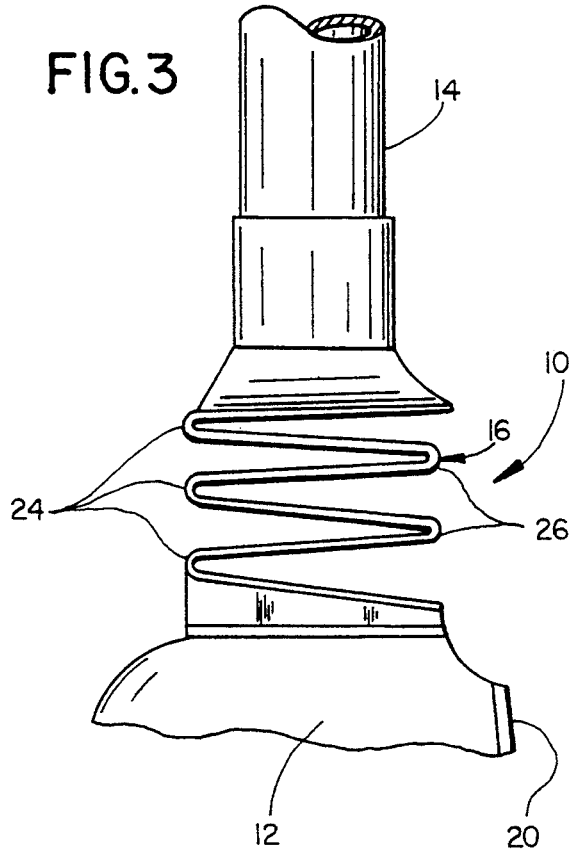
FIG. 3 is a left side elevation of the golf club.
Figure 2:
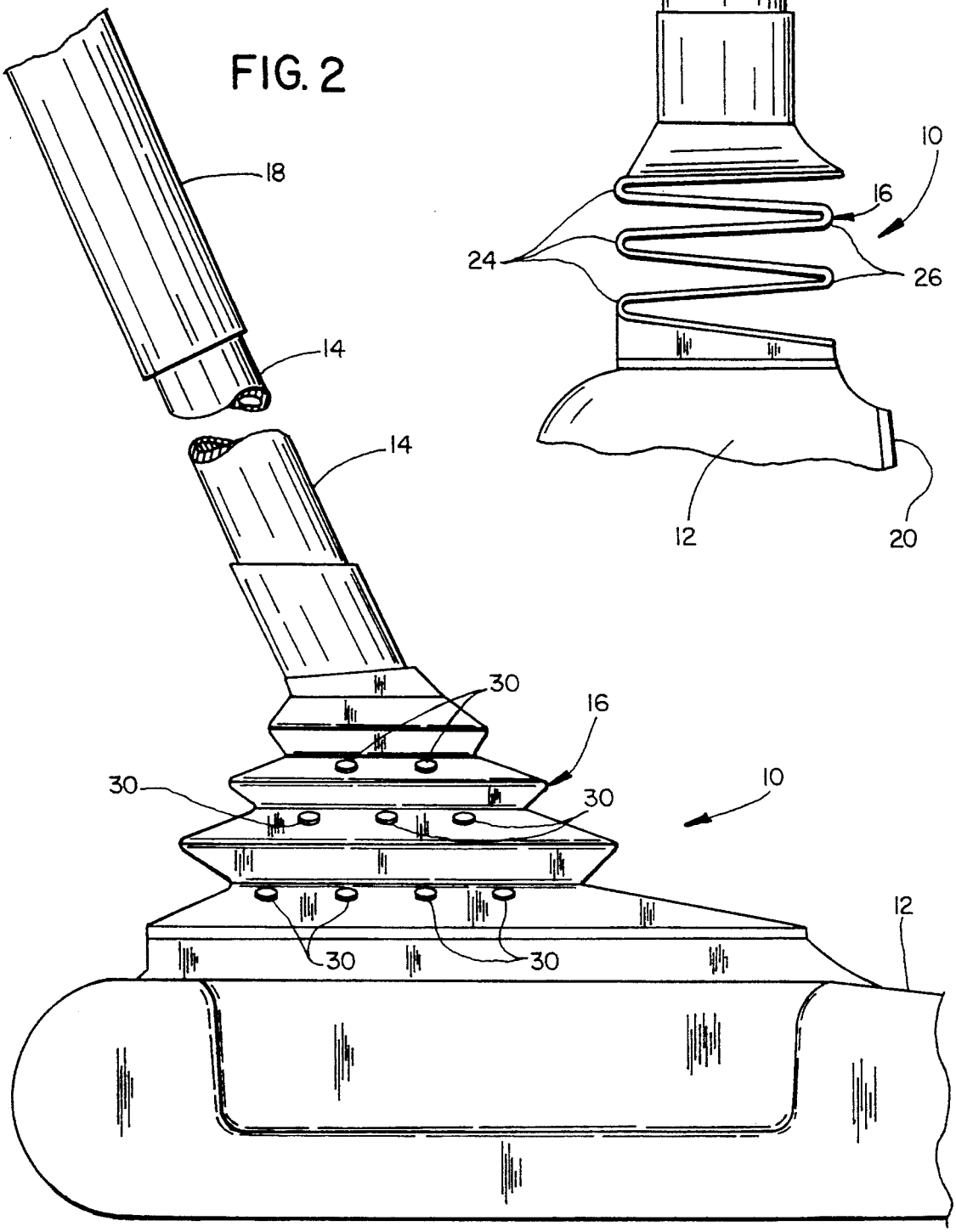
FIG. 2 is a rear elevation of the golf club.

Referring now to the drawings, and in particular to FIGS. 1–3, a golf club constructed according to the principles of the present invention in the form of a putter indicated generally at 10 is shown to comprise a head 12, a shaft 14 extending outwardly from the head and a connector (designated generally by the reference number 16) interconnecting the shaft and the head. The shaft 14 includes a grip portion 18 (FIG. 2) for gripping the putter to swing it. The head 12 includes a generally flat, forwardly directed face 20 which is constructed for striking the ball (not shown). As shown in FIG. 3, the head 12 has an asymmetrical shape about its long axis. However, it is to be understood that the head 12 may have other shapes (symmetrical or asymmetrical) and fall within the scope of the present invention.

In the preferred embodiment, the connector 16 is a thin sheet of material bent into a generally serpentine or zigzag shape (in cross section), and connected at its top end to the shaft 14 and at its bottom end to the club head 12. However, it is to be understood that the connector 16 and head 12, or the connector, head and shaft 14 may be formed as one piece and fall within the scope of the present invention. More specifically the sheet of material includes forwardly opening bends 24 and rearwardly opening bends 26 which are disposed generally one above the other between the shaft 14 and the head 12. The width of the connector 16 (i.e., its dimension parallel to the lengthwise extension of the putter head 12) flares outwardly from its connection to the shaft 14 to its connection with the head of the club.

The connector 16 is more resiliently yieldable than the shaft 14. Thus, sheet of material forming the connector 16 can be of any material having a suitable resiliency. For example, it is believed that a spring steel such as 18-8 SS steel would provide satisfactory results.

The connector 16 is believed to act as a spring to isolate to a certain extent the reaction of the club head 12 from the shaft 14 when the ball is struck. If the putter 10 is held with an ordinary (i.e., not too tight) grip, the connector 16 is not believed to flex when the ball is struck. In that instance, the entire putter 10 is believed to move rearwardly (relative to the direction of motion of the putter when stroking the golf ball) a slight distance in the golfer's hands as the ball is struck. It is further believed that as a result of this motion, the momentum of the golfers arms and upper body are not fully transmitted to the ball. However, if the putter is gripped very tightly the slight rearward motion of the club head 12 is preserved in the present invention by rearward flexing of the connector 16 relative to the rigidly held shaft 14. Thus, with the putter 10 of the present invention, less than the full momentum of the golfer's arms and upper body are transmitted to the ball regardless of the tightness with which the putter is gripped. In this way, it is believed there is a more consistent momentum transfer from the club to the ball, independent of the grip of the golfer. Thus, the golfer is better able to predict the distance of his putts independently of any consideration of how tightly the putter 10 is gripped.

Figure 4:
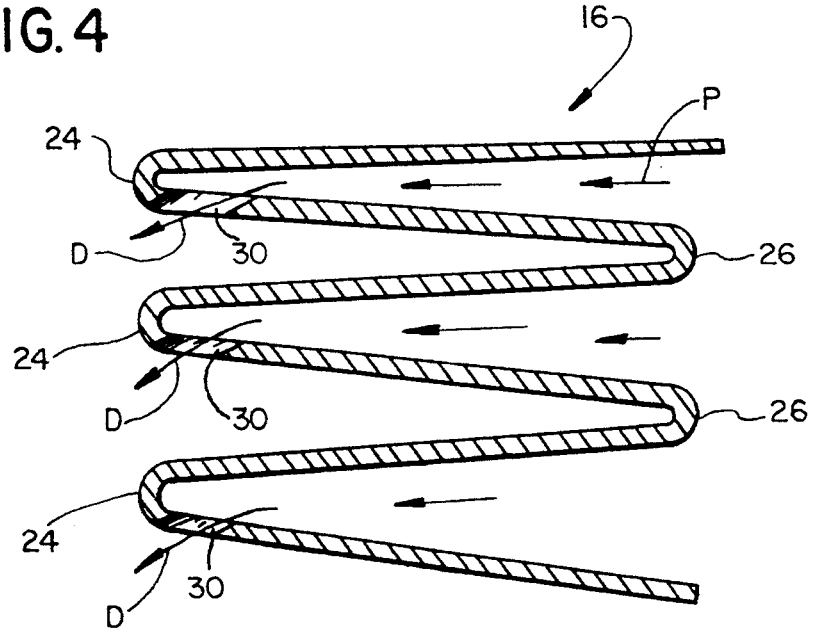
FIG. 4 is an enlarged fragmentary section of a connector connecting the golf club's shaft and head.

The connector 16 is also constructed for deflecting air flowing relative to the putter 10 from a direction P generally perpendicular to the connector, downwardly at an angle to the perpendicular direction (as indicated by arrows D). Of course, in reality the air is generally stationary and the putter head 12 and connector 16 move through the air along an arc as the putter 10 is swung. However, for simplicity the relative movement of the connector 16 and surrounding air is described herein from the vantage of an imaginary observer riding on the head 12 of the putter, to whom the air appears to move and the head appears to be stationary. The references to "downward" herein are also to be interpreted from the imaginary observer's reference frame. In the preferred embodiment, the connector 16 has openings 30 located adjacent the rear end of the forwardly opening bends 24 of the connector. As shown in FIG. 4, the openings 30 face generally downwardly and rearwardly. Thus, it may be seen that air moving as indicated by arrow P into the forwardly opening bends 26 is deflected generally downwardly by the connector to pass through the openings 30. It is believed that the deflection of the air imparts a small lift force on the putter 10 which helps the golfer to lift the putter so that when the ball is struck, substantial topspin is imparted to the ball. The maximum lift occurs at the greatest velocity of the putter, which will be as it strikes the ball. Although the lift is not sufficient to actually raise the putter, the feel of the putter is such that the golfer is reminded to lift the club as the ball is struck.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A golf club comprising a head having a generally forwardly directed face constructed for striking a golf ball, a shaft extending outwardly from the head and having a grip portion thereon for gripping the shaft to swing the club, and a connector located between and interconnecting the head and the shaft, the connector being relatively more resiliently yieldable than the shaft and the head so that the head flexes relative to the shaft about an axis generally perpendicular to the shaft when striking the golf ball with the head of the club.

2. A golf club as set forth in claim 1 wherein the connector comprises a thin sheet of material formed in a generally serpentine shape.

3. A golf club as set forth in claim 2 wherein the width of the connector flare outwardly from its connection with the shaft to its connection with the head of the club.

4. A golf club as set forth in claim 2 wherein the sheet of material has forwardly opening bends and rearwardly opening bends, and openings in the sheet of material permitting the passage of air through the connector.

5. A golf club as set forth in claim 4 wherein the openings face generally downwardly, the connector being constructed for deflecting air moving into at least some of the forwardly opening bends generally downwardly to pass out through the openings.

6. A golf club as set forth in claim 4 wherein the openings are disposed generally adjacent the rear of the forwardly opening bends.

7. A golf club as set forth in claim 6 wherein the openings face generally downwardly, the connector being constructed for deflecting air moving into at least some of the forwardly opening bends generally downwardly to pass out through the openings.

8. A golf club comprising a head having a generally forwardly directed face constructed for striking a golf ball, a shaft extending outwardly from the head and having a grip portion thereon for gripping the shaft to swing the club, and a connector located between and interconnecting the head and the shaft, the connector being constructed for deflecting air flowing relative to the club in a direction generally perpendicular to the connector generally downwardly at an angle to said perpendicular direction.

9. A golf club as set forth in claim 8 wherein the connector has openings therein adapted to pass air through the connector, the connector being shaped at the openings for redirecting air to pass through the openings.

10. A golf club as set forth in claim 9 wherein the connector comprises a thin sheet of material formed in a generally serpentine shape having forwardly opening bends and rearwardly opening bends.

11. A golf club as set forth in claim 10 wherein the width of the connector flares outwardly from its connection with the shaft to its connection with the head of the club.

12. A golf club as set forth in claim 10 wherein the sheet of material has openings therein permitting the passage of air therethrough, the openings facing generally downwardly and the connector is shaped at the openings for deflecting air moving into the forward opening bends generally downwardly to pass through the openings.

13. A golf club as set forth in claim 12 wherein the openings are disposed generally adjacent the rear of the forwardly opening bends.

14. A golf club as set forth in claim 8 wherein the connector is relatively more resiliently yieldable than the shaft and the head of the club.

* * * * *